US005261204A

United States Patent [19]

Neff

[11] Patent Number: 5,261,204

[45] Date of Patent: Nov. 16, 1993

[54] SUSPENDED CEILING FRAMEWORK ASSEMBLY

[76] Inventor: Eric S. Neff, R.D. #2, Box 1737, Chicora, Pa. 16025

[21] Appl. No.: 929,415

[22] Filed: Aug. 14, 1992

[51] Int. Cl.[5] ..... E04B 9/00

[52] U.S. Cl. ..... 52/484; 52/664; 52/488; 52/780

[58] Field of Search ..... 52/484, 712, 489, 780, 52/DIG. 8, 488, 664, 665

[56] References Cited

U.S. PATENT DOCUMENTS

| | | | |
|---|---|---|---|
| 345,944 | 7/1886 | Anderfuren | 52 X/780 |
| 1,079,631 | 11/1913 | Bodley | 52 X/780 |
| 1,609,573 | 12/1926 | Priest et al. | 52 X/780 |
| 3,350,824 | 11/1967 | Wiebusch | 52 X/780 |
| 3,385,020 | 5/1968 | Olson | 52 X/780 |
| 3,470,666 | 10/1969 | Mod et al. | 52 X/780 |
| 3,583,119 | 6/1971 | Kann | 52 X/DIG. 8 |
| 4,281,498 | 8/1981 | Kern | 52/780 |
| 4,454,700 | 6/1984 | Kern | 52 X/780 |
| 4,464,876 | 8/1984 | Kern | 52 X/780 |
| 4,773,200 | 9/1988 | Young | 52 X/780 |
| 4,841,709 | 6/1989 | Peterson | 52 X/780 |

FOREIGN PATENT DOCUMENTS

| | | | |
|---|---|---|---|
| 419613 | 4/1910 | France | 52/780 |

*Primary Examiner*—Carl D. Friedman

*Assistant Examiner*—Beth A. Aubrey

*Attorney, Agent, or Firm*—George C. Atwell

[57] ABSTRACT

A suspended ceiling framework assembly for creating either a flat or an arched ceiling in rooms of various sizes. The arched ceiling assembly includes a pair of wall starter pieces and a pair of arched wall side starter pieces, all of which are mounted to the walls of the room and form a perimeter structure thereon. A plurality of spaced-apart arched main track members span the room from one wall to the other wall and are mounted to the oppositely-disposed wall starter pieces. A plurality of spaced-apart crosspieces are slidably interfitted to the arched main track members and the arched wall side starters. An arched grid system is thus formed for supporting ceiling tiles, lighting fixtures, and vents. The flat ceiling assembly includes four wall starter pieces mounted to the respective walls of the room and which are beveled at their respective ends for joining together to form a continuous perimeter structure about the room. A plurality of spaced-apart main track members span the room from one wall to the opposite wall and are mounted to the respective oppositely-disposed wall starter pieces. A plurality of crosspieces are adapted for spaced-apart, slidable, interfitting attachment to the wall starter pieces and the main track members, and form a grid system or layout for supporting ceiling tiles or panels.

13 Claims, 8 Drawing Sheets

SUSPENDED CEILING FRAMEWORK ASSEMBLY

BACKGROUND OF THE DISCLOSURE

This invention relates to suspended ceiling structures, and more particularly pertains to a wooden, arched suspended ceiling framework assembly which can support ceiling tiles, glass panels, lighting fixtures, etc., for creating an arcuate overhead ceiling.

The home improvement and the home remodeling industry are multi-million dollar businesses whose popularity is growing rapidly as individual homeowners in large numbers take up hammer and drill, router and circular saw, to modify, improve or redo their residences. For example, one of the more popular home improvement projects, which can be accomplished by both professionals or the homeowner, is putting in a finished game room. Adding wood paneled walls, wallpaper, moldings, a chair rail, and baseboard turns a cement block basement into an attractive playroom, TV room, and entertainment room. The transformation is completed by adding overhead lighting fixtures and a drop ceiling.

The typical drop ceiling structure includes starter pieces for securement to the walls of the room to form a perimeter structure about the room. The starter pieces are spaced from the ceiling a predetermined distance and then main channels or runners are disposed in spaced relationship to each other for extension from one starter piece to an opposite starter piece. Crosspieces are then mounted to the channels and starter pieces perpendicularly thereto. In addition, the main channels are further secured by wire hangers that have one end attached to the channels and the other end attached to a fastener, such as a threaded eye hook or wood screw, secured into the overhead ceiling beam or joist. Thus a grid network is defined for receiving ceiling tiles, panels, overhead lighting fixtures, etc.

U.S. Pat. No. 4,773,200 (Young) discloses a wooden suspended ceiling system which supports standard ceiling panels but is also designed to expose certain parts of the wooden ceiling system to view in order to enhance the aesthetic aspects of the system. The Young invention discloses a plurality of wooden runners extending in one direction, and a plurality of wooden cross members supported by the runners and extending in a direction perpendicular to the runners. The cross members serve as spacers for the main runners and define a plurality of openings; the runners and cross members support ceiling tiles and close the openings. The main runners and the cross members each have an upraised central sill portion and a groove on either side of the longitudinal central sill portion. Outboard of each groove is a lip which has an upper horizontal face higher than the groove but lower than the central sill portion. The main runners and the cross members are adapted for interlocking fit to each other.

U.S. Pat. No. 4,841,709 (Peterson et al.) discloses a wooden suspended ceiling assembly that includes a wall-mounted support and beam assembly. The beam assembly comprises a plurality of main beams and a plurality of cross beams with the ends of the cross beams grooved to form an interlocking fit with the side extensions of the main beams. Wood blocks can be attached to the intersections of the cross beams with the main beams for strengthening and further support.

While the above inventions provide a suspended ceiling system, they do not provide the user with the option of constructing a flat or an arched ceiling from easily assembled, pre-cut pieces.

SUMMARY OF THE INVENTION

The present invention comprehends a suspended ceiling framework assembly which can be arched or level in disposition. In either embodiment, the suspended ceiling assembly is mounted to the walls of the room and spaced a predetermined distance from the ceiling. The suspended ceiling assembly is manufactured from pre-cut, finished wood and is mounted to the walls by using, for example, nails, wood screws, or toggle bolts, and supporting the suspended ceiling assembly overhead by attaching wire hangers to the assembly and securing the pendent hangers to eye hooks or screws mounted into the pre-existing, overhead ceiling.

The arched suspended ceiling assembly, which is the preferred embodiment of the present invention, includes a pair of oppositely-disposed wall starter pieces mounted to opposite walls of the room. Disposed adjacent to the remaining two walls, and at right angles to the wall starter pieces, are a pair of opposed arched wall side starter pieces. The arched wall side starter pieces are joined to the wall starter pieces to form a perimeter structure about the room. The peaks of both arches are higher than the wall starter pieces, while the ends of each arched starter piece are disposed adjacent to the flat end portions of the wall starter pieces.

Each wall starter piece has a groove coequal in length therewith and cut at an acute angle: in the preferred embodiment of the present invention the angle of the inner, flat, vertical surface is cut at 12.5°. Mounted into the groove of each wall starter piece are a plurality of starter crosspieces laid end-to-end continuously in each groove. The number of starter crosspieces used is dependent on the length of the particular wall starter piece being used. Each starter crosspiece has a continuous lip which projects inwardly to the room and further defines a flat, horizontal receiving surface for supporting one ceiling tile. The starter crosspieces terminate at recessed or grooved ends, and the recessed end of one starter crosspiece is spaced a slight distance from the recessed end of the adjacent starter piece.

Mounted into the groove of each wall starter piece, and interfitted to the recessed ends of the starter crosspieces, are a plurality of spaced-apart, elongated, arched main track members that extend from one wall starter piece to the opposite wall starter piece. The arch of the main track members is equal in height to the arch of both arched wall side starter pieces. A plurality of elongated crosspieces are adapted for slidable adjustment on, and interfitting attachment to, the arched wall side starter pieces and the arched main track members. The crosspieces are disposed perpendicular to the arched wall side starter pieces and the arched main track members, and when the crosspieces are disposed thereon, a grid system is created for supporting a plurality of ceiling tiles or panels. The ceiling tiles or panels are supported on a pair of oppositely-disposed crosspiece projections integrally formed on each crosspiece and on a pair of opposed main track projections integrally formed on each arched main track member.

In the level suspended ceiling assembly, which is the alternate embodiment of the invention, four wall starter pieces are employed instead of the two wall starter pieces and the two arched wall side starter pieces of the preferred embodiment. In addition, the ends of each wall starter piece are beveled at 45° so that they mate with each other to form a perimeter structure on the walls of the room. Moreover, the alternate embodiment employs a plurality of horizontally-disposed main track members which span the room from one wall to the opposed wall and have their ends mounted to each respective opposed wall starter piece.

It is an objective of the present invention to provide an arched suspended ceiling comprising pieces pre-cut in various lengths and trimmed for providing aesthetic appeal.

Another objective of the present invention is to provide a suspended ceiling framework assembly which can be easily and quickly assembled with a minimum use of carpenter's tools.

It is a further objective of the present invention to provide embodiments for either a level suspended ceiling assembly or an arched suspended ceiling assembly.

Other objects and advantages of the present invention will become apparent in the following specification and claims.

DETAILED DESCRIPTION OF THE PREFERRED EMBODIMENT

Figure 1:
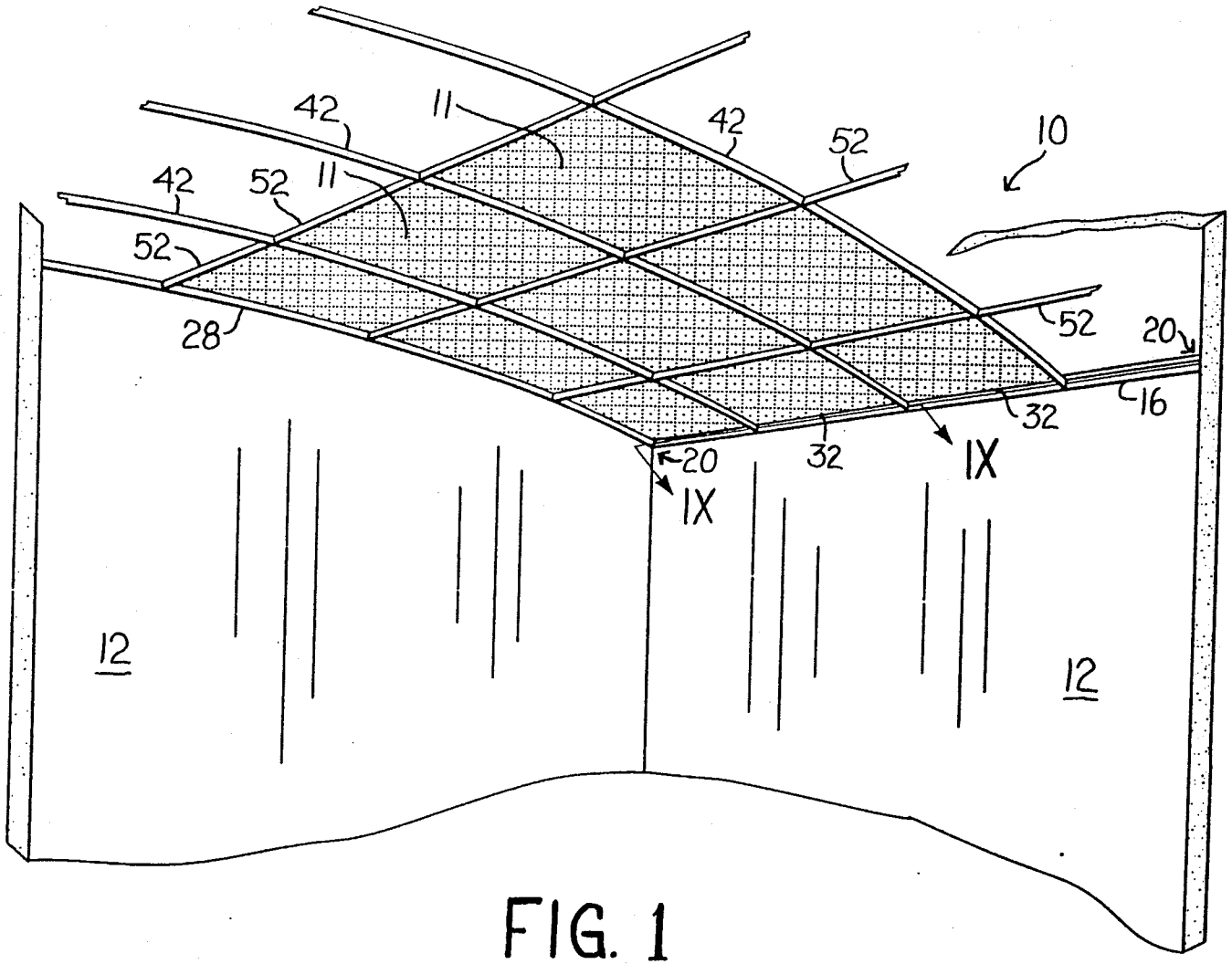
FIG. 1 is an isometric view of an arched suspended ceiling framework assembly in accordance with the present invention.
Figure 10:
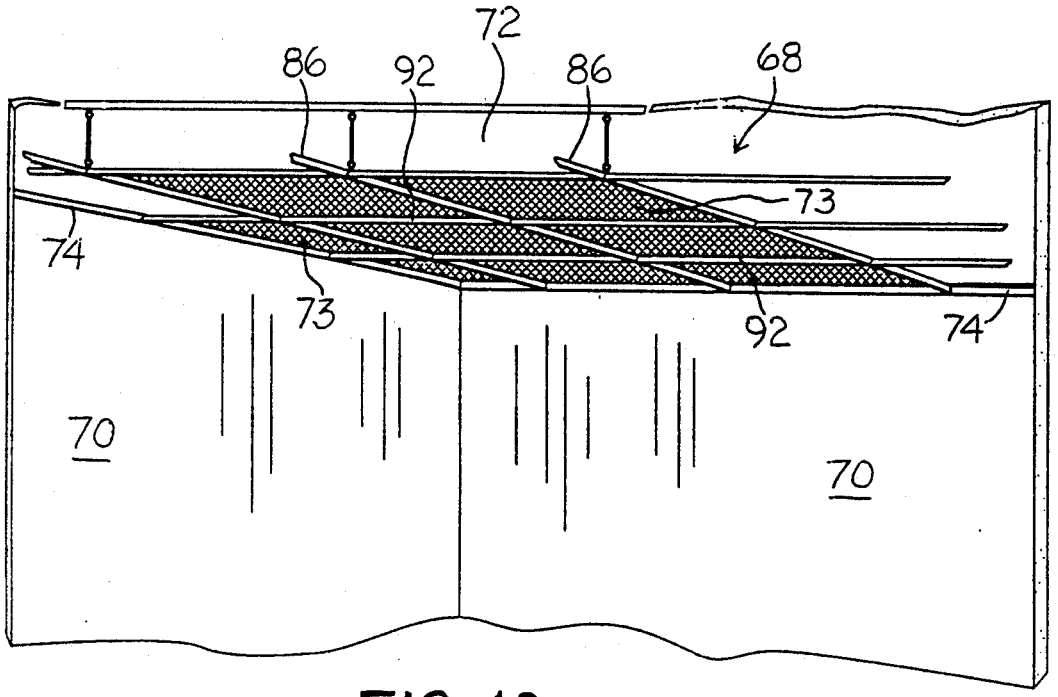
FIG. 10 is an alternate embodiment of a flat suspended ceiling framework assembly containing glass panels illustrated by a bottom perspective view.

Referring to FIG. 1 there is shown an arched, suspended ceiling assembly 10 mounted to the walls 12 of a room for spanning the room with an arched configuration. FIG. 10 also illustrates a ceiling assembly 68 mounted to walls 70 and suspended from an overhead ceiling 72 of the room. The ceiling assembly 10 is adapted for use by both professional homebuilders and also for home remodelers and do-it-yourselfers. The ceiling assembly 10 includes a number of pre-cut and pre-shaped pieces which can be easily installed with a minimum of tools and labor for creating an aesthetically appealing arched ceiling. The various pieces of the ceiling assembly 10 are manufacture from wood to give a pleasant, rustic appearance, and may be pre-cut to various lengths from the factory: standard lengths being eight feet, ten feet, twelve feet, and sixteen feet for the larger pieces and two feet for the smaller pieces. The option always remains for the installer to further cut the various pieces to fit the particular room in which the ceiling assembly 10 is to be mounted. Furthermore, the ceiling assembly 10 is adapted to be mounted to the walls 12 so that any screwing, fastening, or nailing will be out of sight and concealed by the plurality of ceiling tiles 11, panels, or a mixture of ceiling tiles, lighting fixtures, and vents, etc., all of which would be supported by the grid system or layout of the ceiling assembly 10. No mounting methods or means involving nails, screws, fasteners, brackets, or hangers would be visible to individuals standing in the room and looking up at the ceiling assembly 10.

Referring to FIGS. 1–5 and FIG. 10, there is shown one of a pair of elongated wall starter pieces 16 having a generally rectangular cross-section. In the ceiling assembly 10 two wall pieces 16 are utilized, with one wall piece 16 mounted to one wall 12 and the other wall piece 16 mounted to the opposite wall (not shown). Careful measurements must be taken so that each wall piece 16 is spaced the same distance from the ceiling 14 and also from the floor (not shown); each wall piece 16, when mounted to the respective walls 12, must be at the same height and located in the same horizontal plane.

The wall pieces 16 include a number of unique structural features which make them easily and quickly mountable to the walls 12 for receiving and supporting other structural elements which will be described hereinafter and which facilitate creation of the arcuate configuration of the ceiling assembly 10. Each wall piece 16 has a flat, vertically-extending rear surface 18 which is disposed contiguous to the respective wall 12 when the wall piece 16 is mounted thereto. Each wall piece 16 terminates at a pair of oppositely-disposed, flat end portions 20 which, depending upon the installation methods and layout used, may contiguously abut the walls 12 diagonal and at a right angle to the wall 12 on which the wall piece 16 is mounted or the ends 20 may be spaced several inches therefrom. For fully enclosing the perimeter of the room, each wall piece 16 should extend along the length of the respective wall 12 to which it is mounted so that the ends 20 contiguously abut the two walls 12 extending at right angles to the wall 12 on which the wall piece 16 is secured.

Figure 2:
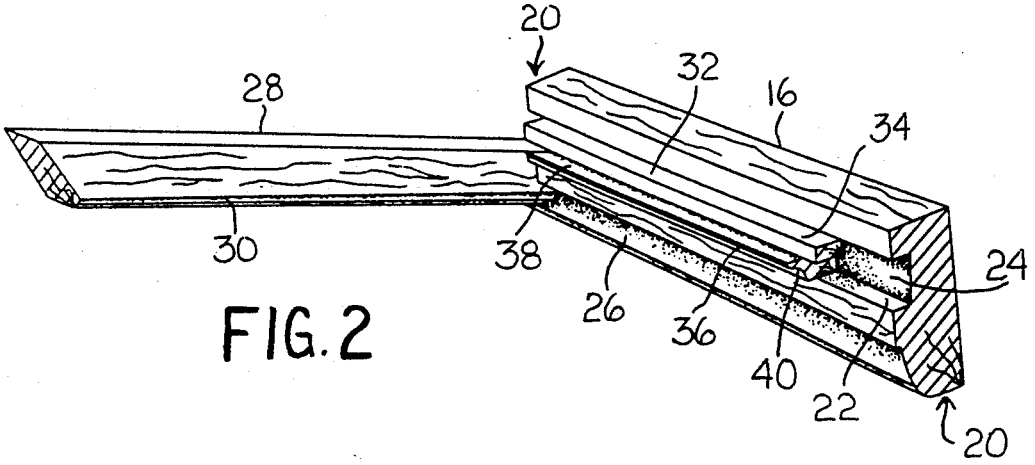
FIG. 2 is an enlarged fragmentary view of structural elements of the invention first shown in FIG. 1.
Figure 3:
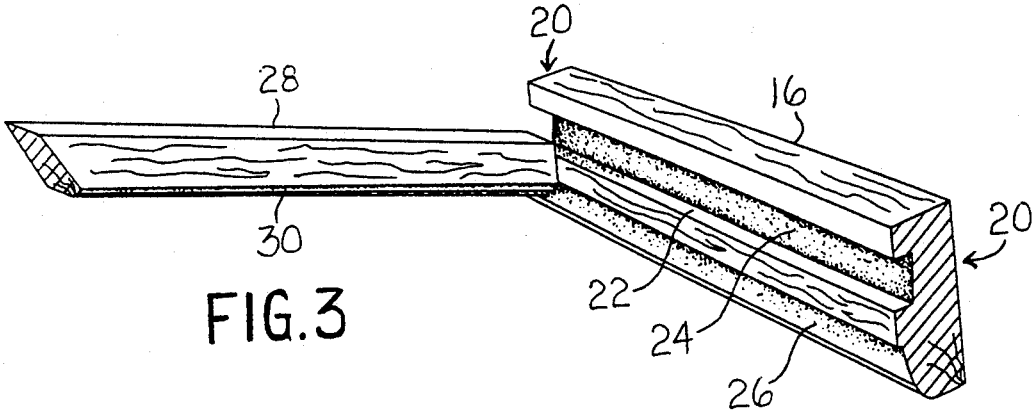
FIG. 3 is an enlarged fragmentary view of structural elements of the invention first shown in FIG. 2 with the starter crosspiece removed.
Figure 4:
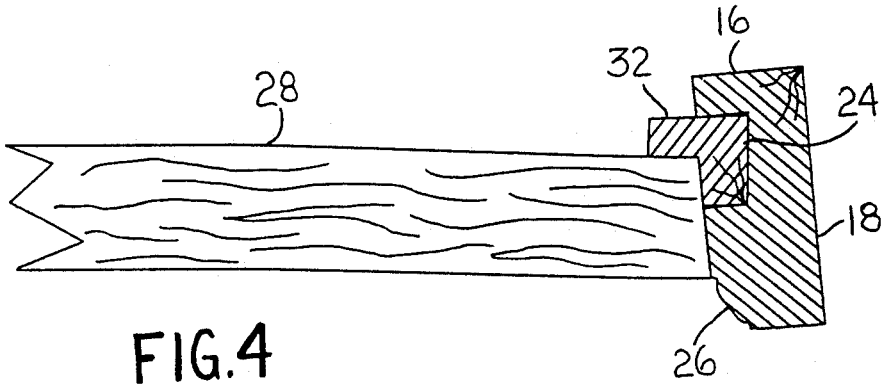
FIG. 4 is a side elevational view of structural elements of the invention first shown in FIG. 2.

Referring to FIGS. 2–4, the wall piece 16 includes a generally rectangular-shaped groove 22 opposite the surface 18 and when each wall piece 16 is mounted to the respective wall 12, the groove 22 faces into the room and toward the wall piece 16 mounted to the opposite wall 12. The groove 22 is coequal in length with the wall piece 16 and has an inner, flat, upwardly-extending back surface 24 cut or shaped at an acute angle. This angled cut to the groove 22 facilitates the creation of the arched effect for the ceiling assembly 10. In the preferred embodiment of the ceiling assembly 10 as shown in FIGS. 2–4, the angle at which the surface 24 is cut will be 12.5°. This angle would be the factory cut of the groove 22 for each wall piece 16; if the installer desired a steeper arch to the ceiling assembly 10, the surface 24 could be cut to a greater angle. However, clearances must be taken carefully into account during the fitting in of other structural elements (which will be described hereinafter) to each wall piece 16 so there is a limit to the angle at which the surface 24 can be cut. The groove 22 itself is cut deep enough into the wall piece 16 for securably receiving and supporting therein other structural pieces. On the lower portion of each wall piece 16 which would be visible to individuals standing in the room and looking up at the ceiling assembly after it has been mounted to the walls 12, there is a smooth and finished rounded portion 26 integrally formed from the wall piece 16 and coequal in length thereto. The portions 26 may be finished with various types of lacquers, shellacs, stains, or varnishes in order to present a pleasing appearance to any viewers.

Shown in FIGS. 1–4 is an elongated, curved or arched wall side starter piece 28. In the ceiling assembly 10, two arched pieces 28 are used for facilitating the arched effect of the ceiling assembly 10 and supporting other structural pieces which will be described hereinafter. The arched pieces 28 are disposed at right angles to the wall pieces 16 and are positioned adjacent or contiguous to the remaining two walls 12. Each arched piece 28 spans the room by extending from one wall piece 16 to the wall piece 16 mounted on the opposite wall 12. As shown in FIGS. 1–4, when each arched piece 28 is disposed in its operative position, its ends will abut the ends 20. The arch of each arched piece 28 is dependent upon its length: a shorter length will give a smaller arch than a longer length. In addition, the major rounded viewable portions 30 of each arched piece 28, shown in FIGS. 2–4 and FIG. 9, are finished to enhance the appearance thereof.

Figure 9:
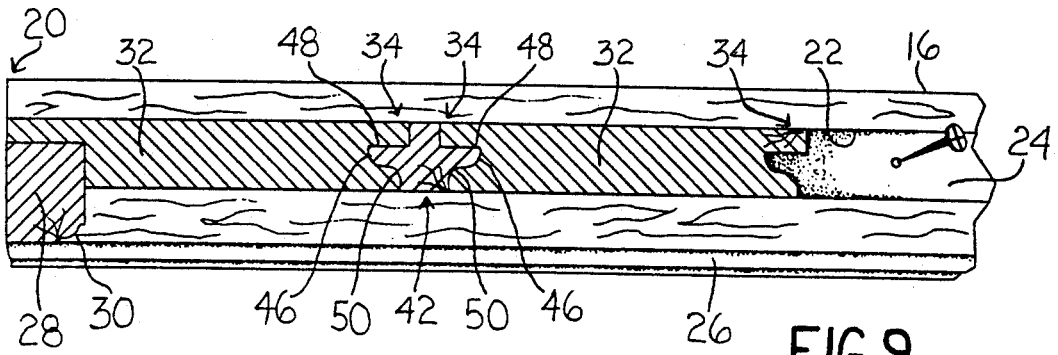
FIG. 9 is a front, vertical cross-sectionad view taken along line IX—IX of FIG. 1 illustrating the interfitting securement of the starter crosspieces to one wall starter piece, the interfitting relationship on one arched main track member to the starter crosspieces, and the interfitting relationship of an arched wall starter piece and one starter crosspiece.

As shown in FIGS. 2, 4, 5, and 9, the ceiling assembly 10 includes a plurality of elongated starter crosspieces 32. The crosspieces 32 are shorter than each wall piece 16 and may be cut to lengths of one or two feet. The crosspieces 32 are mounted within each respective groove 22, as shown in FIGS. 2 and 9, and are cut and trimmed so that they fit snugly within the grooves 22. Each crosspiece 32 abuts the surface 24 and is slightly tilted at generally the same angle as the surface 24 when disposed within the respective groove 22. The number of crosspieces 32 mounted within each respective groove 22 is dependent upon the length of each wall piece 16, the length of each crosspiece 32, and, as shall be more fully described hereinafter, the layout and size of the grid formed by the ceiling assembly 10 disposed in its operative position as shown in FIG. 1.

When the crosspieces 32 are mounted within each groove 22, they form a continuous line within the groove 22 extending from one end 20 to the opposite end 20 of each wall piece 16. However, the crosspieces 32 do not abut each other as they are placed one after another in line in each groove 22 as shown in FIG. 9. The ends 34 of each crosspiece 32 terminate at integrally formed furrows or chamfers which are adapted to receive other structural elements of the ceiling assembly 10 of the present invention. As shown in FIG. 9, the crosspieces 32 are spaced so as to allow a gap between the end 34 of one crosspiece 32 and the end 34 of the next crosspiece 32 mounted within the groove 22. While the crosspieces 32 are snugly mounted within the grooves 22, they can be slidably adjusted within the groove 22 in a linear manner in order to form the grid layout or structure of the ceiling assembly 10 and accommodate the particular ceiling tiles being used. As shown in FIG. 2, each crosspiece 32 is further characterized by having a horizontally projecting lip 36 which is coequal in length with the crosspiece 32 and integrally formed therefrom. The lip 36 includes a flat horizontal receiving surface 38 and an undersurface 40, and when each crosspiece 32 is mounted within each respective groove 22, the lip 36 points inward to the room. The surface 38 is adapted to support and maintain the edge portion of one ceiling panel or tile 11. Because a substantial portion of generally square-shaped cross-section of each crosspiece 32 projects above the surface 38, the perimeter edge of each ceiling tile 11 rests upon the surface 38 and abuts the square-shaped portion of the crosspiece 32. Thus, the ceiling tiles 11 that form the two perimeter or edge rows can be disposed at slight angles with respect to the crosspieces 32 and can be maintained in their angled position without moving or sliding.

Referring to FIGS. 1 and 5–9, in order to form the arched ceiling grid layout, the ceiling assembly 10 of the present invention utilizes a plurality of arched main track members 42 having a slight pliability or flexibility. The arched length and extension of the track members 42 would be factory cut or sized and cut to fit the room in which the ceiling assembly 10 is being constructed. Each main-T or track member 42 extends from one mounted wall piece 16 to the oppositely-disposed mounted wall piece 16 and comprises the transverse ribbing to maintain the arched ceiling grid layout. The arch of each track member 42 should be equal to the arch of both arched pieces 28. Thus, the individual standing in the room and looking up to the ceiling assembly 10 will view a continuous concave structure extending from one wall 12 to the oppositely-disposed wall 12 and completely covering the ceiling 14. Each track member 42 terminates at oppositely-disposed, right-angled, flat end portions 44 integrally formed therefrom and which are mounted within and abut the inner surfaces 24. The ends 44 fit snugly within each respective groove 22 but can be slidably adjusted therein and easily removed therefrom. In addition, each track member 42 includes a pair of integrally formed and opposed main track projections 46 which are coequal in length with the respective track member 42. The projections 46 are adapted for receiving and supporting thereon the ceiling tiles 11. Each projection 46 is more specifically defined by a flat, horizontal receiving surface 48 for supporting the ceiling tiles 11 and an opposed, lower, S-shaped groove 50 beneath the surface 48 and visible by an individual standing in the room when the ceiling assembly 10 is fully constructed.

Figure 5:
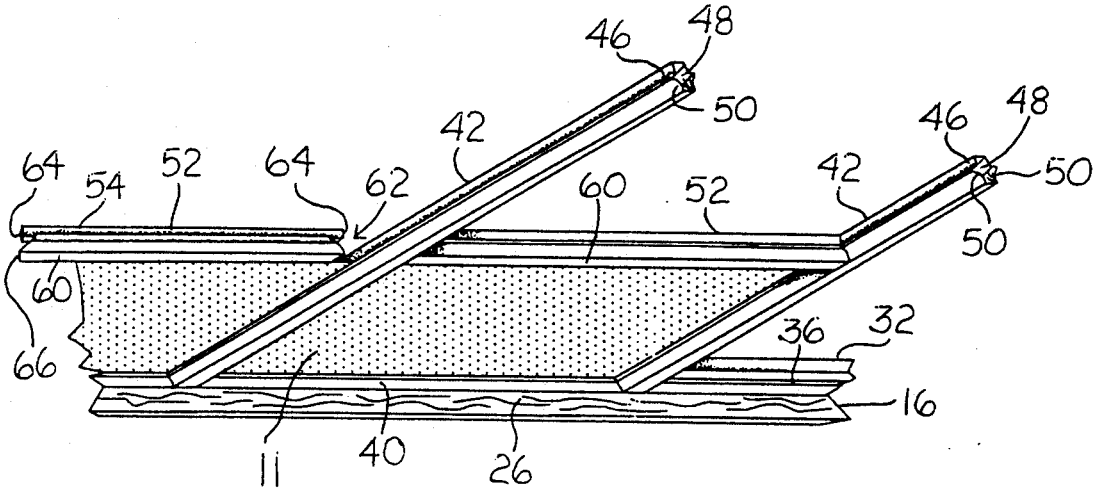
FIG. 5 is a perspective bottom view of the arched suspended ceiling framework assembly first shown in FIG. 1.

Shown in FIGS. 5 and 9, when the track members 42 are disposed in their operative positions, their ends 44 are snugly fitted into the groove 22 and abut the surface 24. The slight angle at which the ends 44 are disposed facilitates arched extension of the track members 42 across the room. As shown most clearly in FIG. 9, the track members 42 are firmly and securely held in place within the groove 22 by the ends 44 contiguously interfitting with the crosspieces 32. More specifically, each projection 46 is mated with and interfits to the furrows or chamfers formed at the ends 34 of the respective crosspieces 32. After determining the layout and dimensions of the ceiling grid based upon the width of the ceiling tiles 11 being used, the crosspieces 32 can be cut down to the appropriate size if they are not already appropriately pre-cut and then the crosspieces 32 can be mounted within the grooves 22 with a gap or space allowed between the continuous line of the crosspieces 32 disposed in each groove 22. Then the ends 44 can be interfitted to the ends 34 so that the projections 46 snugly and contiguously interfit with the integrally formed furrows of the crosspieces 32. This manner of mounting the track members 42 to the wall piece 16 by utilizing the crosspieces 32 as an intermediate mounting member obviates the need to nail, staple, or screw the ends 44 to the oppositely-mounted wall piece 16. If adjustments have to be made in laying out the ceiling grid pattern, they can be easily done by sliding and shifting the crosspieces 32 within the groove 22 and also sliding the track members 42 along with the slidably adjustable and movable crosspieces 32.

Figure 6:
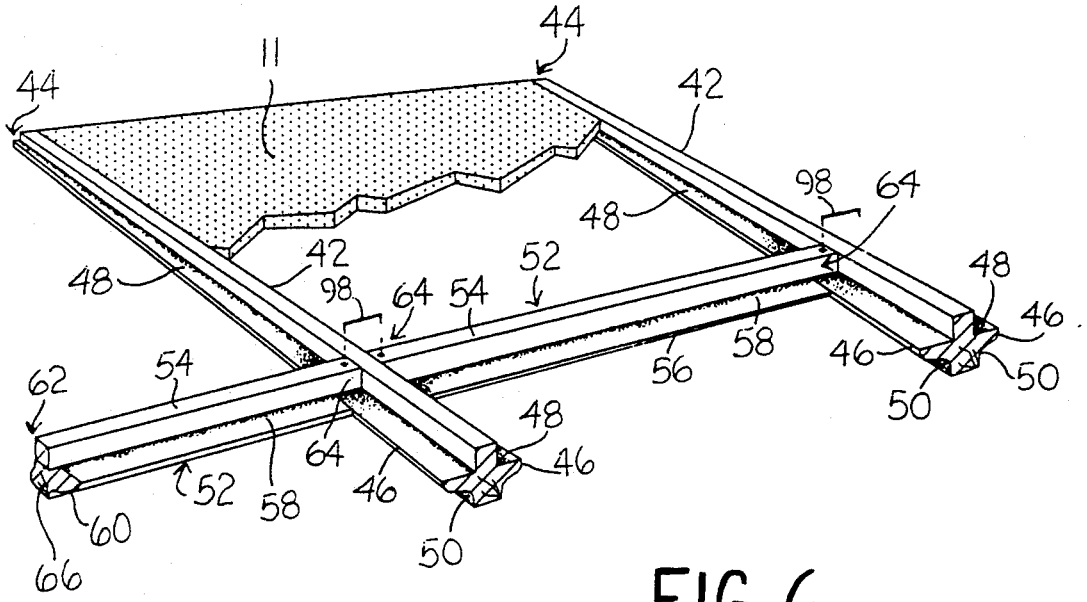
FIG. 6 is a fragmentary top perspective view of the invention first shown in FIG. 1.

Referring now to FIGS. 1 and 5-9, in addition to the wall pieces 16, the track members 42, the crosspieces 32, and the arched pieces 28, the ceiling assembly 10 utilizes a plurality of elongated crosspieces 52 for forming the grid pattern or layout of the ceiling assembly 10 and for supporting and receiving the ceiling tiles 11. As shown in FIGS. 5 and 6, the crosspieces 52 are shorter than the track members 42 and form each particular grid in the grid layout of the ceiling assembly 10. The number of crosspieces 52 used depends on the dimensions of the particular room in which the ceiling assembly 10 is being installed and the size of the individual ceiling tiles 11 which are being used. The crosspieces 52 are adapted for slidable adjustment and interfitting attachment to the arched pieces 28 and the track members 42. The crosspieces 52 can also be cut down to size if ceiling tiles or panels of a small size are being utilized. Generally, the crosspieces 52 will be of the same length as each crosspiece 32. Each crosspiece 52 includes a square-shaped projection 54 centrally positioned thereon and coequal in length therewith. Each projection 54 is integrally formed from each crosspiece 52 and facilitates enclosure of the ceiling tiles 11 within their respective grids and prevents the slidable movement of the tiles 11 as they conform to the concavity of the ceiling assembly 10. In addition, each crosspiece 52 includes a pair of integrally-formed, oppositely-disposed, crosspiece projections 56 which meet the projection 54 at a right angle and are coequal in length with the projection 54. The projections 56 are further defined by a flat, continuous, upwardly-facing crosspiece surface 58 which is adapted for receiving and supporting thereon the perimeter edge of one ceiling tile 11. Each surface 58 is contiguous along its length with the base of the projection 54. The surface 58 receives and supports the perimeter edge of one ceiling tile 11. Oppositely disposed the surface 58 is a finished, downwardly-facing surface 60. This is the portion of the crosspiece 52 which is visible to individuals standing in the room and looking up at the ceiling assembly 10, so it can be finished as desired to enhance the aesthetic appeal of the ceiling assembly 10.

Figure 7:
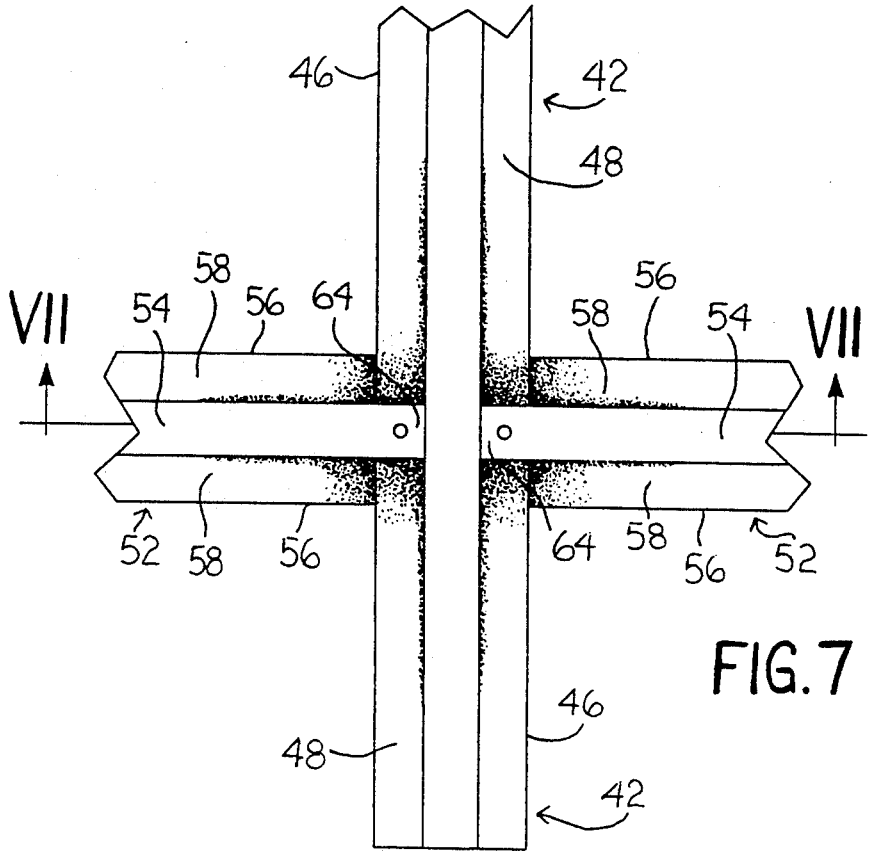
FIG. 7 is a top plan view of the invention first shown in FIG. 1.
Figure 8:
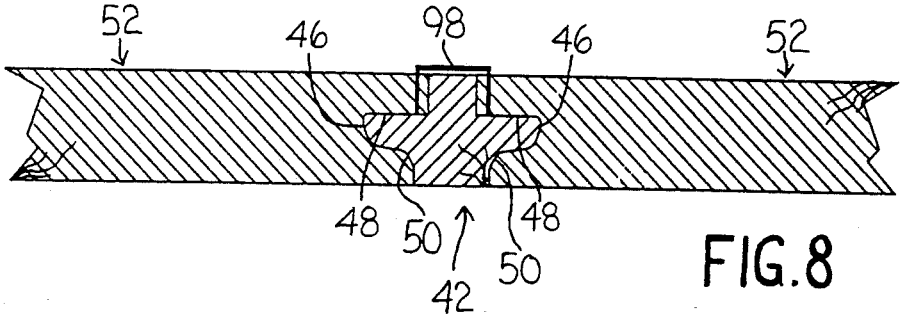
FIG. 8 is a cross-sectional view taken along line VII—VII of FIG. 7 illustrating the attachment of the crosspieces to one arched main track member.

In order to slidably and adjustably interfit each crosspiece 52 to the track members 42 and also to the pair of arched pieces 28 as shown in FIG. 6, each crosspiece 52 terminates at a pair of opposed, integrally formed, specially configured crosspiece ends 62 which are adapted for slidable adjustment on and interfitting attachment to the projections 46 as well as the arched pieces 28. The ends 62 are more specifically defined by a square-shaped prong 64 integrally formed and extending from the projection 54 and a lower projection 66 spaced from the prong 64 which defines a recess or gap therebetween. When the crosspieces 52 are disposed in their operative position, both prongs 64 are contiguously placed on the surfaces 48 as shown in FIGS. 6-8, and each projection 66, which is defined by an S-shaped upper surface, contiguously fits to the groove 50 as also shown in FIGS. 6 and 8. The prongs 64 and the projections 66 are adapted for slidable and linear adjustment and interfitting atachment to the projections 46. Thus, the installer can simply slide the crosspieces 52 along the length of the projections 48 in order to form the appropriate dimensions of each ceiling grid for the ceiling assembly 10.

Figure 11:
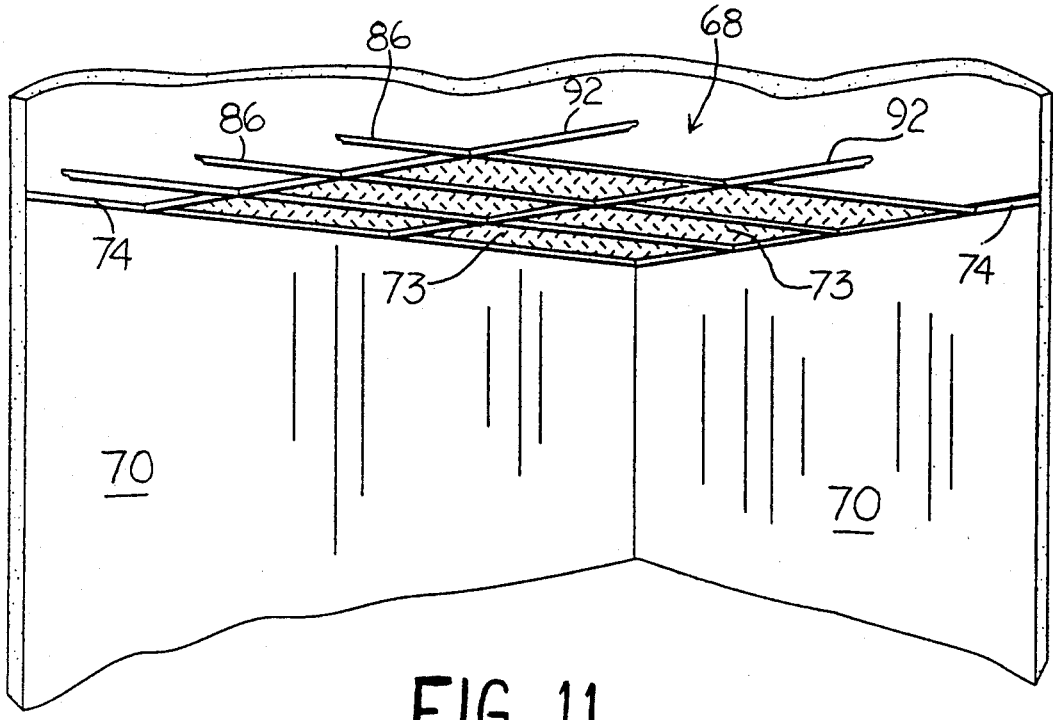
FIG. 11 is a bottom perspective view of the suspended ceiling assembly first shown in FIG. 10 but containing ceiling tiles instead of glass panels.
Figure 12:
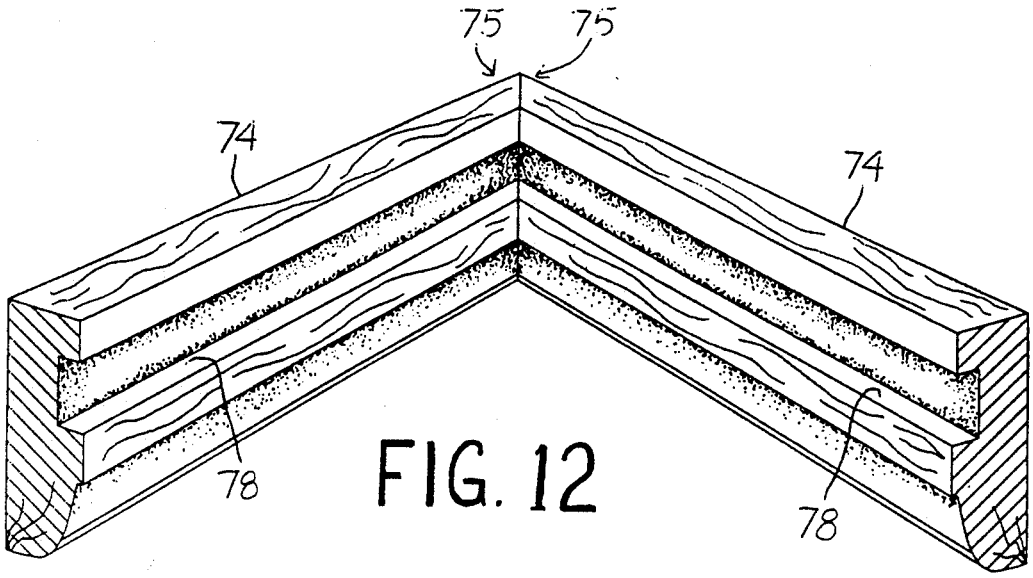
FIG. 12 is a fragmentary perspective view of the flat suspended ceiling assembly first shown in FIG. 10 illustrating the mitered joining of two wall starter pieces.
Figure 13:
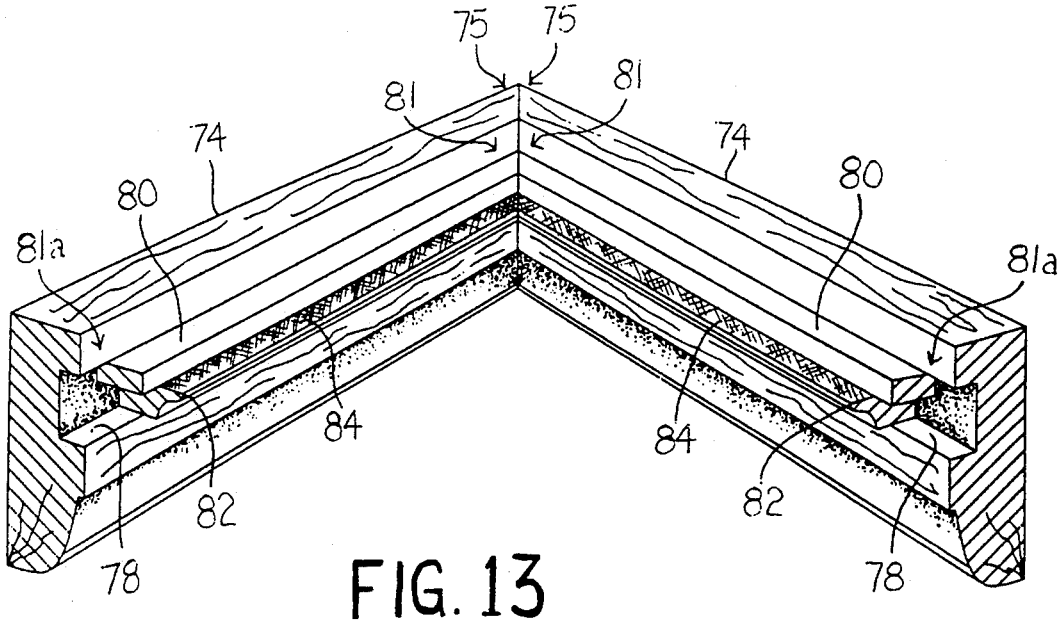
FIG. 13 is a fragmentary perspective view of the level suspended ceiling assembly first shown in FIG. 10 illustrating the mitered joining of two starter crosspieces mounted in two wall starter pieces.

Referring to FIGS. 11-16, there is shown an alternate embodiment of the ceiling assembly of the present invention. Specifically, FIGS. 11-16 illustrate a suspended flat ceiling structure 68 for mounting to the walls 70 of a room, which is spaced a predetermined distance from the ceiling 72 for supporting a plurality of ceiling tiles 73, panels, or other structures in an overhead grid system formed by the layout and installation of the suspended ceiling structure 68. The ceiling structure 68 includes four elongated wall starter pieces 74 which are secured and mounted to the respective walls 70 and are spaced a predetermined distance down from the ceiling 72 and which support other structural elements which will be hereinafter further described. The wall pieces 74, when disposed in their operative position, form a continuous perimeter structure about the room. As shown in FIGS. 12 and 13, the ends of the wall pieces 74 are beveled so as to form a miter joint at each of the corners of the room. Each wall piece 74 terminates at a pair of opposed, flat, beveled ends 75 that are contiguously disposed to the ends 75 of the adjacent wall pieces 74 when all of the wall pieces 74 are disposed in their operative position of being mounted to the respective walls 70 of the room. In addition, each wall piece 74 is further defined by a flat, vertically-extending rearward mounting surface 76 which is disposed contiguous to the respective wall 70 to which the wall piece 74 is secured. Opposite the surface 76 is a rectangular-shaped groove 78 coequal in length with the wall piece 74 and opening or facing inward to the room. Each groove 78 is integrally formed therefrom by being cut out of the respective wall piece 74. Unlike the groove 22 in the preferred embodiment of the ceiling assembly 10, the groove 78 in the alternate embodiment is cut at a right angle in order to form a ceiling grid or layout that extends transversely and in a horizontal and spaced parallel relationship with the ceiling 72. As shown in FIG. 12, one groove 78 is at the same level as the adjacent groove 78 so that the grooves 78 of all four wall pieces 74 form a continuous perimeter around the walls 70.

As shown in FIG. 13, the ceiling structure 68 includes a plurality of starter crosspieces 80, each of which is shorter in length than the wall pieces 74 and which are adapted for removable mounting within the grooves 78. The crosspieces 80 are adapted for slidable adjustment within the length of the grooves 78. Unlike the crosspieces 32 in the preferred embodiment, the crosspieces 80 in the alternate embodiment are positioned in a level and horizontal manner within the grooves 78 and cannot be angled or tilted back as in the preferred embodiment. It will be noted that the crosspieces 80 that are located at either end of each wall piece 74 have their ends 81 beveled as shown in FIG. 13 so that they conform to the beveled ends 75. In all, eight crosspieces 80 would have the shape as illustrated in FIG. 13 as two crosspieces 80 would form the mitered joint for each of the four corners of the room. All of the other crosspieces 80 in the alternate embodiment would have both their ends 81*a* furrowed, chamferred, or recessed, as shown in FIG. 13, in the same manner as the crosspieces 32 of the preferred embodiment. The crosspieces 80 as shown in FIG. 13 would be cut to size in order to correspond to the dimensions of the ceiling tiles 73 being used by the installer. As many crosspieces 80 as would be necessary to fill each groove 78 in a continuous end-to-end alignment would be utilized by the installer. Thus, the crosspieces 80 also form a perimeter around the walls 70 of the room along with the four wall pieces 74 in which they are mounted.

As shown in FIG. 13, the crosspieces 80 are further characterized by having a major portion of generally square-shaped cross-section which is that portion of each crosspiece 80 substantially disposed within the groove 78, and an inwardly-projecting member 82, facing into the room, which is coequal in length to, and integrally formed therefrom, the respective crosspiece 80. The projecting member 82 has a flat, upwardly-facing surface 84 for receiving and supporting thereon the perimeter edge of one ceiling tile 73. The undersurface of the crosspiece 80 is cut and formed in the same manner as the crosspiece 32 of the preferred embodiment; and the undersurface can be finished in the same manner as the undersurfaces 40 of the preferred embodiment to enhance their aesthetic appeal. The finished undersurface of each crosspiece 80 is that portion of the crosspiece 80 visible by an individual standing in the room when the ceiling structure 68 is fully installed within the room.

As shown in FIGS. 10, 11, 14, and 16, the flat ceiling structure of the alternate embodiment includes a plurality of elongated, horizontally-disposed main T-s or main track members 86 which span the room from one wall piece 74 to the wall piece 74 which is mounted to the opposite wall 70. The track members 86 are disposed and arranged in level, parallel, spaced relationship with each other. The track members 86 are spaced from one wall 70 to the opposite wall 70 with equal distances between each track member 86 in order to receive and accommodate the particular ceiling tiles 73 being used by the installer. Each track member 86 terminates at opposed main track ends 88 which are adapted for mounting into the grooves 78 of the two opposed wall pieces 74 and are also adapted for interfitting attachment with the adjacently-disposed crosspieces 80 mounted within the respective grooves 78. More specifically, the crosspieces 80 are disposed within the grooves 78 in the same manner that the crosspieces 34, as shown in FIG. 9, are disposed within the grooves 22. The ends 88 are adapted for mating with and slidable interfitting to the recessed ends 81*a*. Each track member 86 spans the entire width of the room and all are disposed in the same longitudinal direction to each other. Moreover, each track member 86 includes a support means for receiving and supporting thereon ceiling tiles 73 or other overhead structures, such as lighting and vent structures. The ceiling tile support means of the track members 86 are a pair of opposed main track projections 90 that are integrally formed from and are coequal in length with each track member 86. The horizontal extension of each projection 90 need only extend far enough to support the perimeter edge of the ceiling tiles 73.

Figure 14:
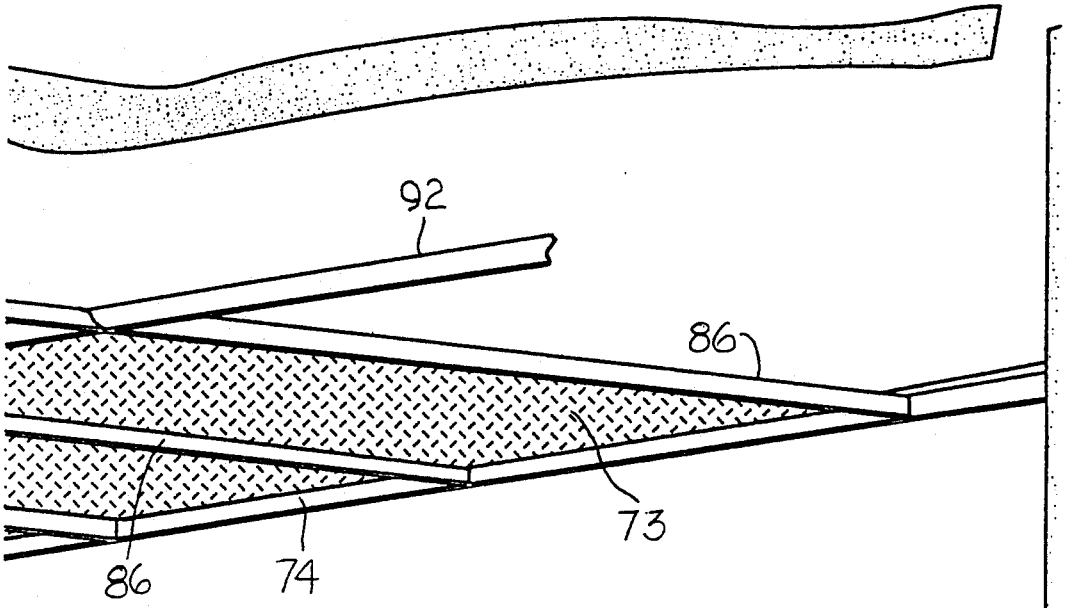
FIG. 14 is a fragmentary bottom perspective view of the flat suspended ceiling framework assembly first shown in FIG. 10.
Figure 15:
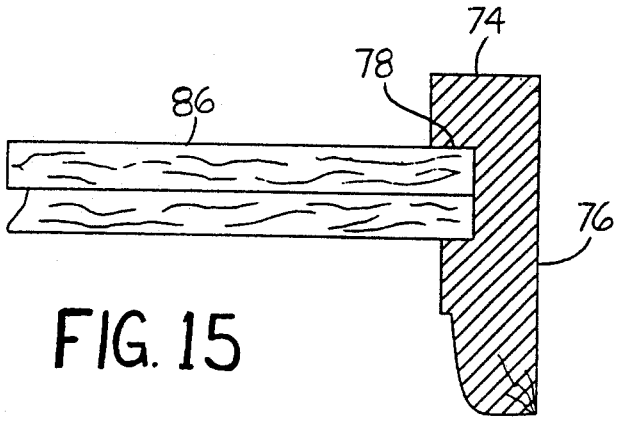
FIG. 15 is a side elevational fragmentary view of the flat suspended ceiling framework assembly first shown in FIG. 10.
Figure 16:
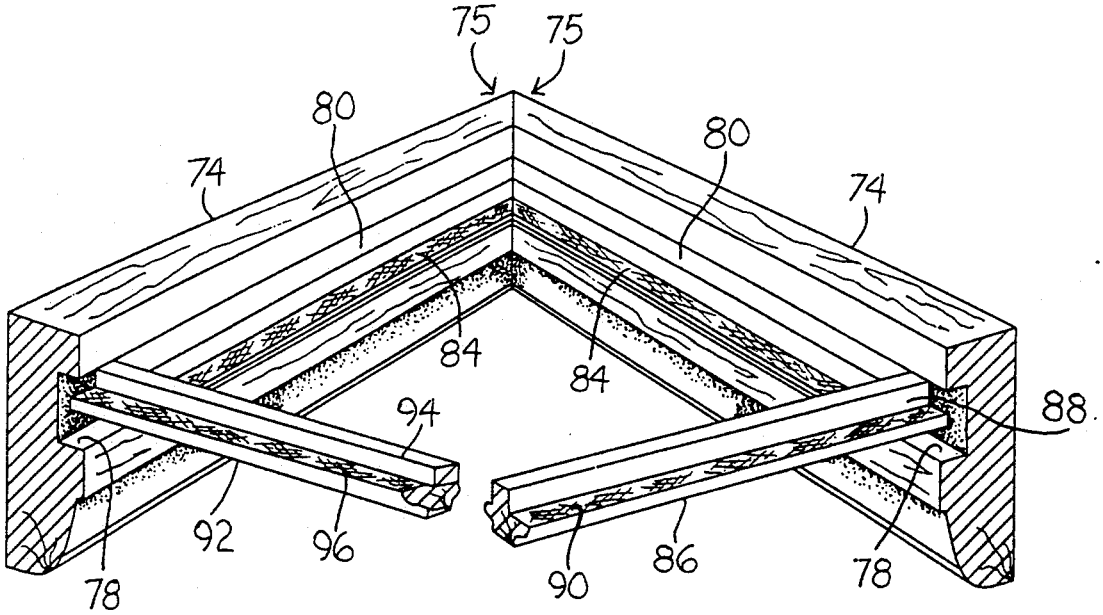
FIG. 16 is a sectioned elevational view of structural elements of the flat suspended ceiling framework assembly first shown in FIG. 15.

As illustrated in FIGS. 11, 14, and 16, in order to complete the construction of the grid pattern or layout of the ceiling structure 68, a plurality of crosspieces 92, shorter in length than the track members 86 and the wall pieces 74 are utilized. The crosspieces 92 are adapted for slidable adjustment on and interfitting attachment and mounting to the track members 86 and the wall pieces 74. The crosspieces 92 are disposed horizontal and perpendicular to the track members 86 and perpendicular to two of the four wall pieces 74. The crosspieces 92 are the same length as the crosspieces 80 so that the spacing of the track members 86 from each other is equal in order to support all of the ceiling tiles 73 without gaps or crevices showing through. Each crosspiece 92 has a square-shaped upright member 94 centrally positioned on the crosspiece 92 and coequal in length therewith and integrally formed therefrom. In addition, each crosspiece 92 includes an integrally formed pair of opposed, horizontally-extending crosspiece projecting members 96 which are also coequal in length with each respective crosspiece 92. The projecting members 96 are adapted for receiving and supporting thereon the perimeter edge of one side of one ceiling tile 73.

Referring to the preferred embodiment of the present invention as shown in FIGS. 1–9, a suggested method of installing the ceiling assembly 10 will now be described. Before installing the ceiling assembly 10, any desired lighting should be placed or affixed to the ceiling 14 if some type of glass panel is going to be used with the ceiling assembly 10 that would allow the light to shine through.

The first step is to draw or mark a level line with chalk or pencil on all four walls 12 at the desired height of the lowest part of the arch, and leaving at least seven inches from the apex of the arch to the ceiling 14. In addition, there should be at least three inches of clearance between the apex of the arch and any overhead lights, such as fluorescent lights, mounted to the ceiling 14.

The chalk line defines a perimeter around the room and also the continuous line along with the two wall pieces 16 should be placed for securement to each respective and opposite wall 12. With the installer making sure that he or she stays on the chalk line, each wall piece 16 is mounted to the respective wall 12 by nailing or screwing through the center of the groove 22, as shown in FIG. 9, and into the wall 12.

The nailing or screwing through each wall piece 16 and into the wall 12 should be appropriately spaced along the length of each wall piece 16. After each wall piece 16 is securely mounted to each respective wall 12, the grid pattern can then be laid out on, for example, grid paper and sketched until the desired pattern is achieved. Center lines can be marked on the walls 12 and immediately below the center of each wall piece 16, and then a track member 42, designated the main T or track member 42, is cut longer than the room's width to provide for the arch. The longer the track member 42, the higher the apex of the arch. The track member 42 is centrally positioned in the room between the opposed wall pieces 16, and the ends 44 are disposed within each respective groove 22 so as to abut the surfaces 24 at an angle. This track member 42 will serve as the center T. If adjustments in the height of the arch have to be made, then each end 44 can be equally trimmed off.

On each side of this center T track member 42, track members 42 can be positioned in equal spaced relation to the center T track member 42 with their ends 44 disposed within the grooves 22. The spacing of the two track members 42 from the center T track member 42 should be equal to the width of the ceiling tiles 11 so as to allow them to be supportably received along their perimeter edges by the surfaces 48 of the track members 42.

The installer can then insert the crosspieces 32 into the grooves 22, in between and contiguously interfitting to, the ends 44 of the center T track member 42 and the two track members 42 disposed in equal spaced relation on either side of the center T track member 42. The furrowed or recessed ends of the crosspieces 32 slidably and contiguously interfit with that portion of the projections 46 adjacent the ends 44 as shown in FIGS. 5 and 9. The length of the crosspiece 32 should equal the distance between the center T track member 42 and the two opposed track member 42.

This process of mounting track member 42 outwardly on either side of the main T track member 42 is continued until the entire room is spanned with track members 42 equally spaced from each other. As the track members 42 are positioned, crosspieces 32 are placed within the grooves 22. The crosspieces 32 maintain the spacing of the track members 42 from each other, and can be mounted to each wall piece 16 by nailing or screwing through the square-shaped cross-section of the crosspieces 32. However, this is not necessary as the snug interfitting of the crosspieces 32 to the ends 44 will maintain the disposition of the crosspieces 32 within the grooves 22. The crosspieces 32 at the ends of each wall piece 16 must be specially cut as shown in FIG. 9 to accommodate each arched piece 28. Each arched piece 28 is cut to fit from one end 20 of one wall piece 16 to the end 20 of the opposed wall piece 16, and the height of the arch of the arched pieces 28 must be equal to the arches of the track member 42. The ends of each arched piece 28 must be cut at a slight angle as shown in FIGS. 2–4 and raised 3/8" up past each respective groove 22 for properly abutting the ends 20. FIG. 9 illustrates how far above the portions 26 the arched pieces 28 are positioned. The arched pieces 28 are fastened through the front to the wall pieces 16, and then the holes are put-tied over.

As shown in FIGS. 2 and 9, the crosspieces 32 positioned at the ends of the wall pieces 16 must have ⅜" added to their proper lengths, and a notch must be cut out at one end 34 of all four crosspieces 32 to contiguously overlap the ends of each arched piece 28. The arcuate ribbing of the ceiling assembly 10 is now in place and the ceiling grid needs to be completed.

As illustrated in FIGS. 1 and 5–8, the crosspieces 52 can now be added to complete the ceiling assembly 10. The spacing of the crosspieces 52 should correspond to the previously sketched ceiling grid pattern. The crosspieces 52 are slidably interfitted and attached to the track members 42 as previously described and U-clips 98, as shown in FIGS. 6 and 7, span one track member 42 at each joint to join two adjacent crosspieces 52 and to maintain the longitudinal disposition of all the crosspieces 52. The end crosspieces 52 must be cut ⅜" longer than their proper lengths and then notched in a manner similar to the end crosspieces 32 shown in FIG. 9 so as to contiguously fit to the arched pieces 28. Eye hooks can then be screwed into each track member 42 at the apex, and eye hooks can also be screwed into the ceiling 14 immediately thereabove. Guide wires can be strung from the eye hooks fastened into the ceiling 14 to the eye hooks fastened to each track member 42. Adjusting the wire length facilitates adjustment of the track members 42 so their apexes are the same distance from the ceiling 14. Finally, the ceiling tiles 11 can be placed within the completed grid of the assembly 10.

This invention having been described in its preferred embodiment and one alternate preferred embodiment, it is clear that it is susceptible to numerous modifications and embodiments within the ability of those skilled in the art and without the exercise of the inventive faculty. Accordingly, the scope of this invention is defined by the scope of the following claims.

I claim:

1. An arched ceiling assembly for mounting to the walls of a room in a spaced relation a predetermined distance beneath the room ceiling for the purpose of supporting a plurality of ceiling tiles, comprising:

a pair of elongated wall starter pieces intended for separate attachment to opposed walls of the room, each wall starter piece terminating at a pair of oppositely-disposed flat end portions and having a flat, vertically-extending rear surface disposed contiguous to the walls, each wall starter piece including a rectangular-shaped groove opposite the flat surface for facing into the room;

each groove coequal in length with each wall starter piece and further characterized by having an inner, flat surface formed at an acute angle;

a plurality of starter crosspieces for mounting within each groove continuously along the length thereof and abutting the inner flat surface of each groove;

each starter crosspiece further characterized by having a projecting lip and each projecting lip including a flat receiving surface and an undersurface;

a plurality of spaced-apart, arched main track members for extending from one wall starter piece to the other wall starter piece, each arched main track member having oppositely-disposed flat end portions for mounting within and abutting the inner flat surfaces of the grooves of each wall starter piece;

means for holding the arched main track members firmly in place by the flat end portions interfitting with the starter crosspieces;

a pair of arched wall side starter pieces for positioning opposite each other and at right angles to the wall starter pieces, each arched wall side starter piece for disposition adjacent to the remaining walls and spanning the room by extending from the flat end portion of one wall starter piece to the flat end portion of the opposite wall starter piece; and a plurality of crosspieces for slidable adjustment on, and for interfitting attachment to, the arched wall side starter pieces and the arched main track members whereby the disposition of the crosspieces will form a grid system beneath the ceiling for supporting the ceiling tiles.

2. The arched ceiling assembly of claim 1 wherein the inner flat surface of each groove has an angle of 12.5°.

3. The arched ceiling assembly of claim 1 wherein each arched main track member includes a pair of opposed main track projections integrally formed from the main track member and coequal in length therewith for receiving and supporting thereon the ceiling tiles.

4. The arched ceiling assembly of claim 3 wherein each main track projection is formed by a flat, horizontal receiving surface for supporting the ceiling tiles and a lower S-shaped groove opposite and beneath the flat horizontal receiving surface.

5. The arched ceiling assembly of claim 1 wherein each crosspiece includes a square-shaped projection centrally positioned on the crosspiece and coequal in length therewith, each square-shaped projection facilitating enclosure of the ceiling tiles within their respective grids.

6. The arched ceiling assembly of claim 5 wherein each crosspiece includes a pair of oppositely-disposed crosspiece projections meeting the square-shaped projection at a right angle and coequal in length with the square-shaped projection.

7. The arched ceiling assembly of claim 6 wherein each crosspiece projection defines a flat, continuous, upwardly-facing crosspiece surface for receiving and supporting thereon one ceiling tile, the crosspiece surfaces contiguous along their length with the base of the square-shaped projection.

8. The arched ceiling assembly of claim 7 wherein each crosspiece projection includes a downwardly-facing surface in opposed relationship with the upwardly-facing, flat crosspiece surface.

9. The arched ceiling assembly of claim 1 wherein each crosspiece terminates at a pair of opposed, specially configured crosspiece ends adapted for slidable adjustment on and interfitting to the main track projections of the arched main track members.

10. The arched ceiling assembly of claim 9 wherein each crosspiece end includes a square-shaped prong integrally formed from the square-shaped projection for contiguous placement on the flat, horizontal receiving surfaces of each main track projection.

11. The arched ceiling assembly of claim 10 wherein each crosspiece end includes a lower projection spaced from the square-shaped prong for defining a recess therebetween, the lower projection having an S-shaped upper surface which contiguously fits to the lower S-shaped groove of each main track projection.

12. The arched ceiling assembly of claim 1 wherein each starter crosspiece terminates at oppositely-disposed recessed ends that are adapted to slidably interfit to the main track projections adjacent the flat end portions of the main track members in order to facilitate mounting of the main track members to the wall starter pieces.

13. A suspended ceiling structure for mounting to the walls of a room in a spaced relation a predetermined distance from the room ceiling for supporting a plurality of ceiling tiles in an overhead grid system formed by the suspended ceiling structure, comprising:

four wall starter pieces for mounting to the room walls to form a perimeter structure about the room;

each wall starter piece terminating at opposed, flat beveled ends that are contiguous with the beveled ends of the other wall starter pieces when the wall starter pieces are disposed in their operative position;

each wall starter piece further characterized by having a flat, vertically-extending mounting surface for disposition contiguous to the respective wall when the wall starter piece is mounted thereto and an opposite rectangular-shaped groove opening and facing away from the mounting surface;

a plurality of starter crosspieces shorter in length than the wall starter pieces for disposition adjacent one another in a continuous line within the grooves of the wall starter pieces;

the starter crosspieces further characterized by having a major portion of generally square-shaped cross-section being substantially disposed in the groove, and projecting member;

each projecting member characterized by a flat, continuous, upwardly-facing surface for receiving and supporting ceiling tiles thereon and an undersurface facing away from the upwardly-facing surface;

a plurality of main track members for spanning the room in a horizontal disposition from one wall starter piece to the opposed wall starter piece, the main track members having opposed main track ends adapted for mounting within the grooves of the opposed wall starter pieces and in interfitting attachment to the starter crosspieces;

each main track member including ceiling tile support means for receiving and supporting ceiling tiles;

a plurality of crosspieces shorter in length than the main track members and adapted for slidable adjustment on and interfitting attachment to the main track members and the wall starter pieces; and each crosspiece further characterized by a square-shaped upright member centrally positioned on the crosspiece, and coequal in length thereto, and a pair of opposed, horizontally-extending crosspiece projecting members adapted for receiving and supporting thereon ceiling tiles.

* * * * *